US008405548B2

(12) United States Patent
Hull, Jr. et al.

(10) Patent No.: US 8,405,548 B2
(45) Date of Patent: Mar. 26, 2013

(54) MULTI-ORIENTATION PHASED ANTENNA ARRAY AND ASSOCIATED METHOD

(75) Inventors: William P. Hull, Jr., Fairview, TX (US); George F. Barson, Plano, TX (US); James S. Wilson, Hurst, TX (US); James M. Irion, II, Allen, TX (US)

(73) Assignee: Raytheon Company, Waltham, MA (US)

( * ) Notice: Subject to any disclaimer, the term of this patent is extended or adjusted under 35 U.S.C. 154(b) by 316 days.

(21) Appl. No.: 12/851,174

(22) Filed: Aug. 5, 2010

(65) Prior Publication Data

US 2012/0032849 A1 Feb. 9, 2012

(51) Int. Cl.
*H01Q 3/02* (2006.01)

(52) U.S. Cl. ..... 342/374

(58) Field of Classification Search ..... 342/374
See application file for complete search history.

(56) References Cited

U.S. PATENT DOCUMENTS 3,916,416 A 10/1975 Lewis
5,534,874 A 7/1996 Yujiri et al.
5,852,419 A 12/1998 Yujiri et al.
5,943,007 A 8/1999 Yujiri et al.
6,292,364 B1 9/2001 Fitzgerald et al.
6,734,828 B2 5/2004 Shor
6,903,697 B2 6/2005 Ogino
6,943,551 B2 9/2005 Eberler et al.
7,129,908 B2 10/2006 Edward et al.
7,136,011 B2 11/2006 Mork et al.
7,154,434 B1 12/2006 Sego
7,170,446 B1 1/2007 West et al.
7,400,215 B2 * 7/2008 Deckman et al. ..... 333/125
7,532,171 B2 5/2009 Chandler
2003/0043085 A1 3/2003 Park et al.
2008/0238774 A1 * 10/2008 Ratni ..... 342/372
2008/0238801 A1 10/2008 Ragan
2009/0204372 A1 8/2009 Johnston et al.

* cited by examiner

*Primary Examiner* — Harry Liu
(74) *Attorney, Agent, or Firm* — Daly, Crowley, Mofford & Durkee, LLP

(57) ABSTRACT

According to one embodiment, an antenna apparatus includes first and second antenna arrays configured in a support structure. Each antenna array has multiple antenna elements that transmit and/or receive electro-magnetic radiation. The elements of the first antenna array are oriented in a boresight direction that is different from the boresight direction in which the elements of the second antenna array are oriented. A plurality of switches alternatively couples the first antenna elements or the second antenna elements to a signal distribution circuit.

20 Claims, 8 Drawing Sheets

MULTI-ORIENTATION PHASED ANTENNA ARRAY AND ASSOCIATED METHOD

TECHNICAL FIELD OF THE DISCLOSURE

This disclosure generally relates to antenna arrays, and more particularly, to a multi-orientation phased antenna array and associated method.

BACKGROUND OF THE DISCLOSURE

Electro-magnetic radiation at microwave frequencies has relatively more distinct propagation and/or polarization characteristics than electro-magnetic radiation at lower frequencies. Antenna arrays that transmit and receive electro-magnetic radiation at microwave frequencies, such as (AESAs), may be useful for transmission and/or reception of microwave signals at a desired polarity, scan pattern, and/or look angle. AESAs are typically driven by a signal distribution circuit that generates electrical signals for transmission by the AESA, and may also be used to condition electro-magnetic signals received by the active electronically scanned array.

SUMMARY OF THE DISCLOSURE

According to one embodiment, an antenna apparatus includes first and second antenna arrays configured in a support structure. Each antenna array has multiple antenna elements that transmit and/or receive electro-magnetic radiation. The elements of the first antenna array are oriented in a boresight direction that is different from the boresight direction in which the elements of the second antenna array are oriented. A plurality of switches alternatively couples the first antenna elements or the second antenna elements to a signal distribution circuit.

Some embodiments of the disclosure may provide numerous technical advantages. For example, one embodiment of the multi-orientation antenna array may provide up to twice the field-of-view (FOV) relative to other antenna arrays that only generate transmit or receive beam in a single direction. This expanded FOV is provided by two antenna arrays that are mounted together in a configuration such that two independently controlled beams may be generated. This configuration of the two antenna arrays may also enable re-use of certain components for reduced weight, size, and costs relative to other antenna arrays. In certain cases, the antenna apparatus may also forego the need for gimbal and servo mechanisms that may further reduce the cost, weight, and power requirements associated with antenna arrays.

Some embodiments may benefit from some, none, or all of these advantages. Other technical advantages may be readily ascertained by one of ordinary skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

It should be understood at the outset that, although example implementations of embodiments are illustrated below, various embodiments may be implemented using any number of techniques, whether currently known or not. The present disclosure should in no way be limited to the example implementations, drawings, and techniques illustrated below. Additionally, the drawings are not necessarily drawn to scale.

Figure 1:
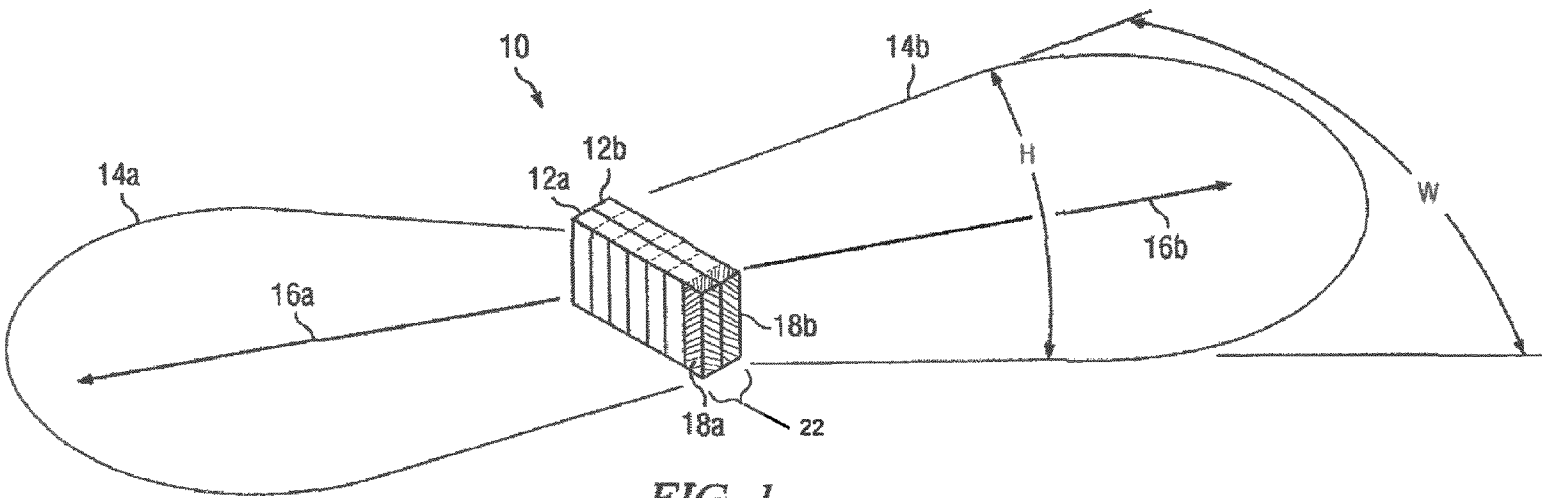
FIG. 1 is an illustration showing one embodiment of a multi-orientation antenna array, including stacked modular element assemblies, according to the teachings of the present disclosure.

FIG. 1 is an illustration showing one embodiment of a multi-orientation antenna array 10 according to the teachings of the present disclosure. Multi-orientation antenna array 10 includes a first antenna array 12*a* and a second antenna array 12*b* arranged in a support structure that in this particular embodiment, includes an enclosure that is common to first antenna array 12*a* and a second antenna array 12*b*. Each antenna array 12*a* and 12*b* transmits or receives electro-magnetic radiation represented by scan volumes 14*a* and 14*b* having an azimuthal width W and an elevation height H. As will be described in detail below, multi-orientation antenna array 10 provides an enhanced scan volume without incurring drawbacks of conventional active electronically scanned arrays (AESAs), using switches that alternatively couple corresponding first antenna array 12*a* or second antenna array 12*b* to a signal distribution circuit.

First antenna array 12*a* includes multiple antenna elements 18*a* that are oriented in a plane perpendicular to direction 16*a*; and second antenna array 12*b* includes multiple antenna elements 18*b* that are oriented in a plane perpendicular to direction 16*b*. When antenna elements 18*a* of first antenna array 12*a* are energized with signals having a similar amplitude and phase, it generates a beam within scan volume 14*a*. Likewise, when antenna elements 18*b* of second antenna array 12*b* are energized with signals having a similar amplitude and phase, it generates a beam within the scan volume 14*b*. Switches may be implemented to alternatively couple antenna elements 18*a* or antenna elements 18*b* to drive circuitry in multi-orientation antenna array 10. Additional details of certain embodiments of switch configurations that may be implemented are described in detail with respect to FIGS. 3 and 4.

In the particular embodiment shown, antenna arrays 12*a* and 12*b* operate at frequencies in the range of 8 to 10 Gigahertz (GHz), have an aperture size of approximately 4 feet$^2$, and has a peak transmitting power of approximately 5 Watts peak power per radiating element. Other embodiments may have similar or differing characteristics including lower or higher frequencies, lower or higher peak power per element, and different aperture sizes. In the particular embodiment shown, each antenna array 12*a* and 12*b* provides a scan volume 14*a* and 14*b* having an azimuthal width W of approximately 120 degrees and an elevational height H of approximately 60 degrees. Thus, the effective scan volume 14*a* and 14*b* provided by antenna array 10 may be approximately 240 degrees along the azimuthal extent around antenna array 10. In other embodiments, each antenna array 12*a* and 12*b* may have an azimuthal width W greater than 120 degrees or less than 120 degrees. Additionally, each antenna array 12*a* and 12*b* may have an elevational height H greater than 60 degrees or less than 60 degrees.

First and second antenna arrays 12*a* and 12*b* may have any suitable number and type of antenna elements 18*a* and 18*b*. For example, in the particular embodiment shown in FIGS. 2A and 2B (discussed further below), each antenna array 12*a* and 12*b* includes two polarized radiating elements (e.g., 18*a*' and 18*a*") that are orthogonal relative to one another. In other embodiments, each antenna array 12 may include only a single polarized radiating element 18, or one antenna array 12*a* may include only a single polarized radiating element 18 while the other antenna array 12*b* includes only single polarized element 18 that is orthogonal to radiating element 18 configured on antenna array 12*a*. Antenna elements 18*a* and 18*b* of FIG. 1 can be part of the modular element assembly 22, represented by the shaded elements in FIG. 1. The modular element assembly 22 can, in one embodiment, be stacked to form a portion of each antenna array 12*a* and 12*b*, as shown in FIGS. 2A-2C, discussed further herein.

Certain embodiments of antenna array 10 may provide an enhanced field-of-view (FOV) for scan volumes 14*a* and 14*b* that may be 180 degrees, or approximately 180 degrees, with respect to one another at a reduced weight and cost relative to known antenna arrays. Antenna array 10 utilizes two sets of antenna elements 18*a* and 18*b* housed in a common support structure. In certain embodiments, antenna elements 18*a* and 18*b* share common radio frequency (RF), power circuitry, signal circuits, structural plates, and/or cooling structures. This commonality may provide reduced weight and/or cost relative to other antenna arrays.

AESAs may provide inertialess scanning over a FOV that is limited by the element pattern of the individual radiating elements. Antenna arrays having a relatively large FOV have typically been achieved by either mounting the AESAs on a gimbal having a servo mechanism to position the FOV at the desired angle, or by configuring multiple AESAs in a fixed installation. For the particular case in which the desired FOVs of the two scan volumes 14*a* and 14*b* are 180 degrees with respect to one another, the invention described herein may provide an antenna array 10 having reduced weight and lower cost relative to the known AESAa in certain embodiments.

Figure 2A:
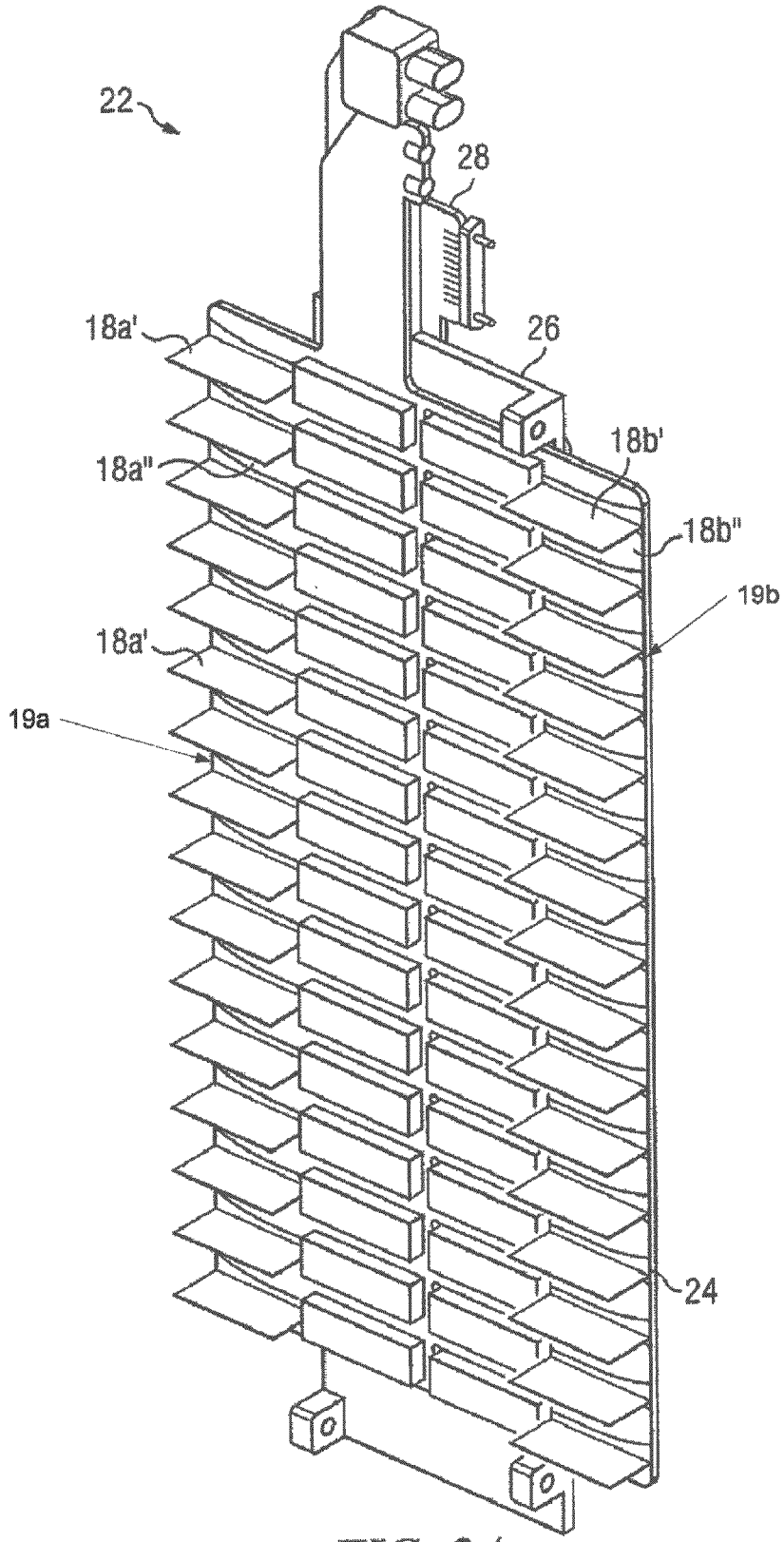
FIGS. 2A and 2B are enlarged, perspective and enlarged, exploded views, respectively, showing one embodiment of a modular element assembly that forms a portion of each antenna array of FIG. 1.
Figure 2B:
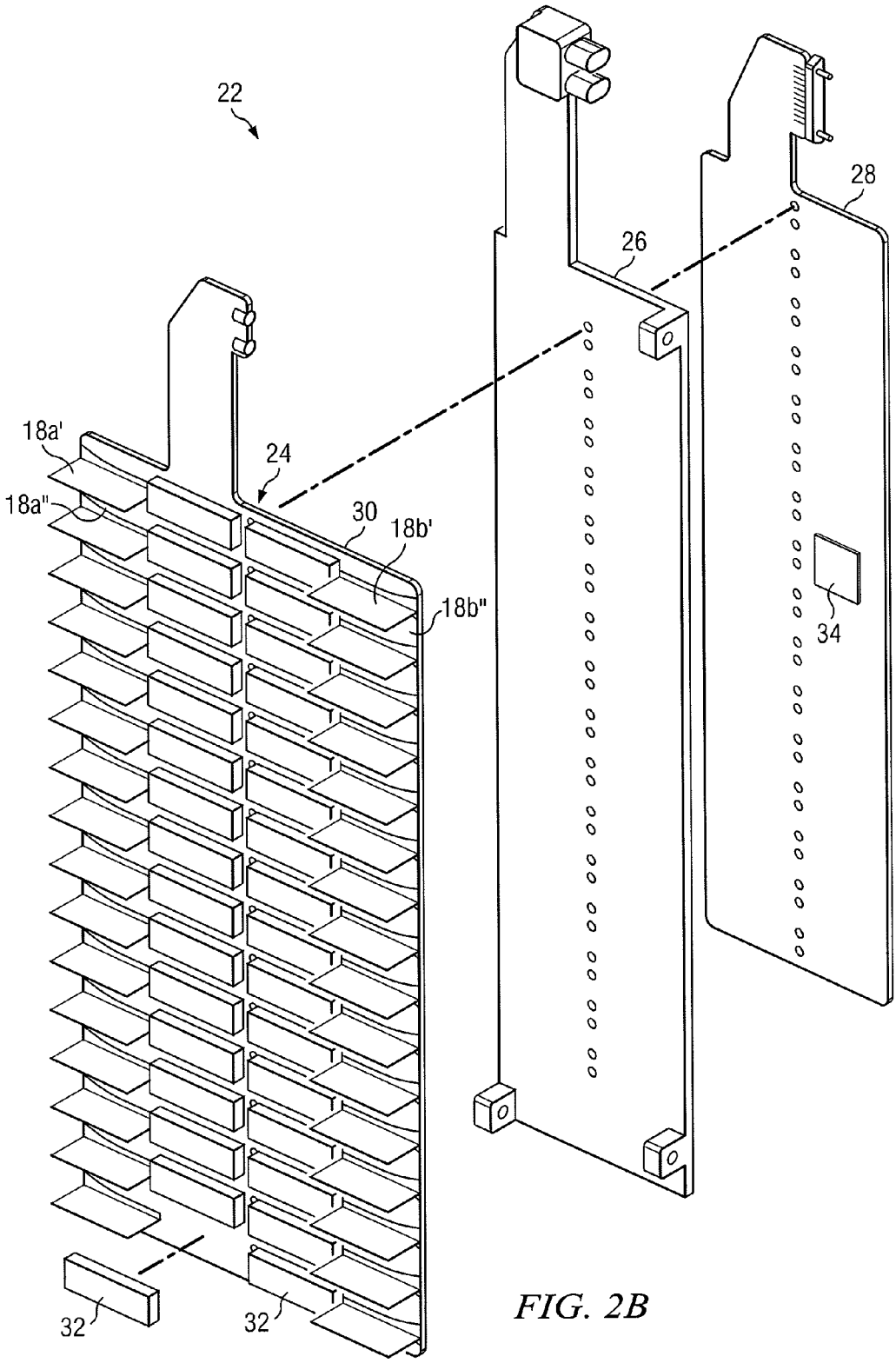
Figure 2C:
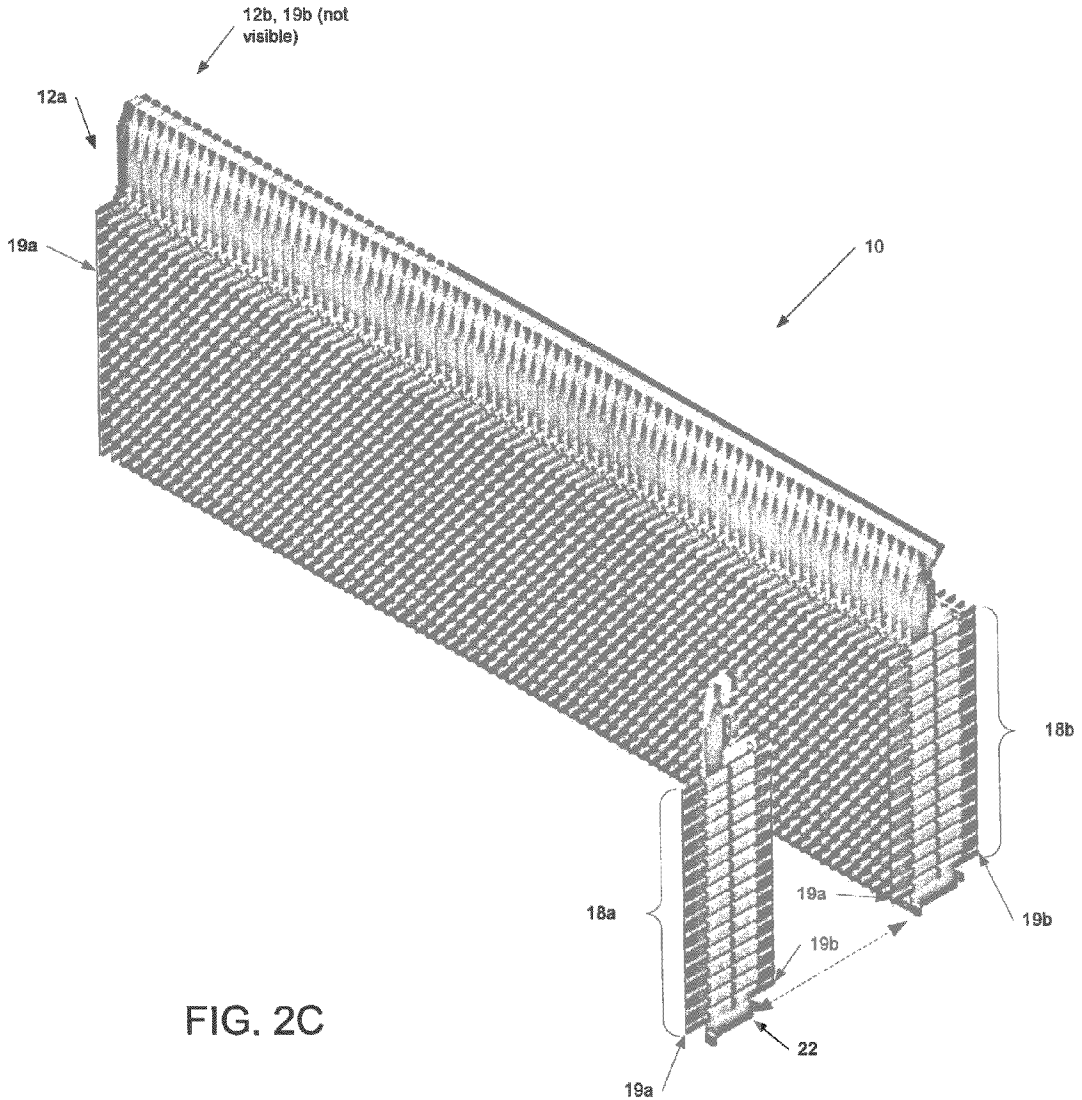
FIG. 2C is an illustration of the modular element assembly of FIGS. 2A and 2B, stacked with other modular element assemblies, to form a portion of the multi-orientation antenna array of FIG. 1.

FIGS. 2A and 2B are enlarged, perspective and enlarged, exploded views, respectively, showing one embodiment of a modular element assembly 22 that forms a portion of each antenna array 12*a* and 12*b* of FIG. 1. Modular element assembly 22 includes a circuit board 24, a coldplate 26, and a power and control signal interface board 28. In certain embodiments, power and control interface 28 may be included in modular element assembly 22 or be a separate circuit board. Multiple modular element assemblies 22 may be stacked beside each other, as shown in FIGS. 1 and 2C, to form first antenna array 12*a* and second antenna array 12*b*. FIG. 2C is an illustration of the modular element assembly 22 of FIGS. 2A and 2B, stacked as shown in FIG. 1, to form a portion of the multi-orientation antenna array of FIG. 1

Figure 3:
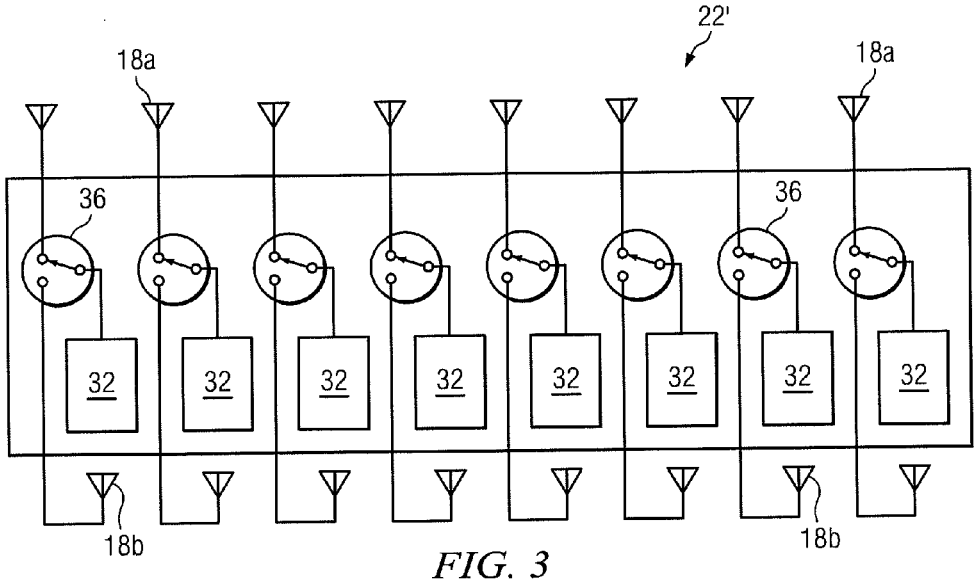
FIG. 3 is a schematic diagram showing a coupling arrangement of the various components that may be implemented on one embodiment of a modular element assembly as shown with respect to FIG. 2.
Figure 4:
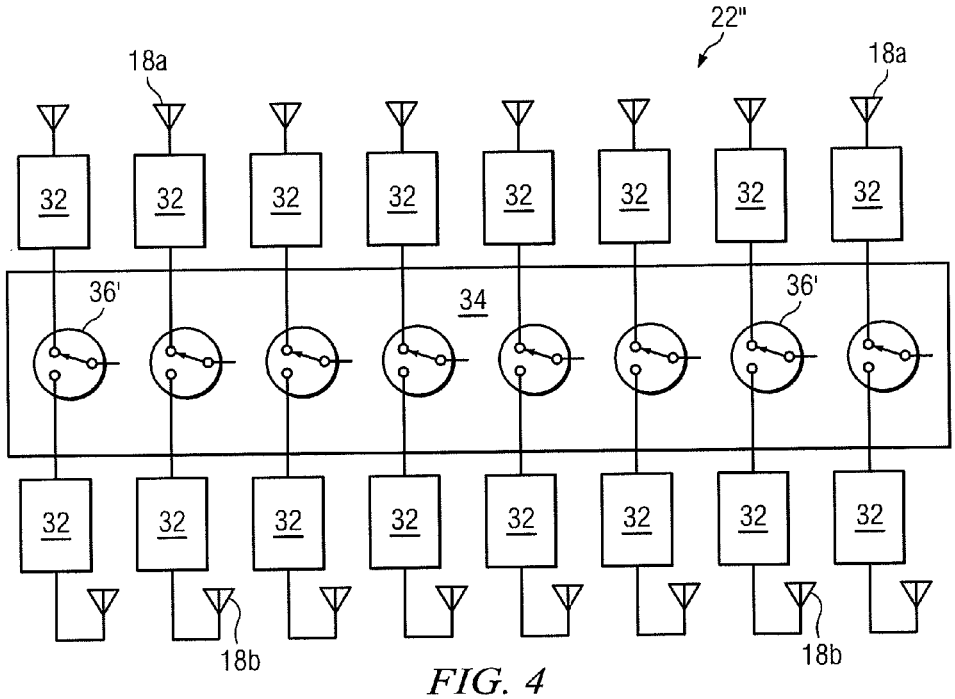
FIG. 4 is a schematic diagram showing another coupling arrangement of the various components that may be implemented on another embodiment of a modular element assembly of FIG. 2.

Referring to FIGS. 2A and 2B, circuit board 24 includes a printed wiring board 30, multiple signal channels 32, and multiple antenna elements 18*a*", and 18*b*", and multiple switches 36 or 36' (FIG. 3 or 4). Circuit board 24 may also include antenna elements 18*a*' and 18*b*' that are oriented orthogonally relative to antenna elements 18*a*" and 18*b*". Signal channels 32 may include active and/or passive circuitry utilised to provide the amplitude and phase for the radiated or received signals. Signal channels 32 may be packaged in hermetic modules or be packaged without hermetic modules in which protective coatings or other means are applied to provide suitable control of the environment around signal channels 32.

In the particular embodiment shown, antenna elements 18*a*', 18*b*', 18*a*", and 18*b*" comprise slotline radiators. In certain embodiments, antenna elements 18*a*', 18*b*', 18*a*", and 18*b*" may be any device that is adapted to radiate electromagnetic radiation upon excitation at a desired frequency.

Power and control interface 28 may include various components that may include, but are not limited to one or more signal distribution circuits 34.

Referring to FIGS. 1 and 2A-2C, when arranged in multi-orientation antenna array 10, one outer edge 19*a* of circuit board 24 is aligned along the aperture of first antenna array 12*a* and its other outer edge 19*b* is aligned with the aperture of second antenna array 12*b*. Thus, antenna elements 18*a* of antenna array 12*a* and antenna elements 18*b* of antenna array 12*b* may be formed on a common printed wiring board 24. Certain embodiments of multi-orientation antenna array 10 may provide advantages over other antenna arrays in that multiple antenna arrays 12*a* and 12*b* may leverage reduced parts count of certain components for reduced weight, size, and/or cost relative to other antenna array designs.

Coldplate 26 is thermally coupled to printed wiring board 24 and functions as a cooling system to convey heat away from signal channels 32 during operation of multi-orientation antenna array 10. In the particular embodiment shown, coldplate 26 is formed of a thermally conductive material, such as aluminum. In other embodiments, coldplate may be made of any suitable material and have any shape that conveys heat away from circuit board 24 or power and control interface 28. For example, coldplate 26 may include a fluid that is configured to transfer heat away from components of circuit board 24 by undergoing a phase change in the presence of close thermal coupling with its components. As can be seen, antenna array 12*a* and antenna array 12*b* share a common cooling system that further serves to reduce weight, size, and/or costs relative to other antenna array designs.

FIG. 3 is a schematic diagram showing a coupling arrangement of the various components that may be implemented on one embodiment of a modular element assembly 22' as shown with respect to FIG. 2. This particular coupling arrangement includes multiple radiating elements 18*a* that form first antenna array 12*a*, multiple radiating elements 18*b* that form second antenna array 12*b*, and multiple signal channels 32 that transfer electrical energy to or receive electrical energy from antenna elements 18*a* and 18*b*. The coupling arrangement of modular element assembly 22' also includes multiple switches 36 that alternatively couple signal channels 32 to each antenna element 18*a* and 18*b* of its respective antenna array 12*a* and 12*b*.

Each signal channel 32 of modular element assembly 22' is common to first antenna array 12*a* and second antenna array 12*b*. In operation, each signal channel 32 may be alternatively coupled to either an antenna element 18*a* of first antenna array 12*a* or an antenna element 18*b* of second antenna array 12*b*. That is, first antenna array 12*a* or second antenna array 12*b* may be used while the other remains idle. Thus, the beam generated by first antenna array 12*a* may be steered in one direction, while the beam generated by second antenna array 12*b* is steered in a another direction independently of the direction in which the beam of first antenna array 12*a* is steered.

Switches 36 may be actuated to select which of first antenna array 12*a* or second antenna array 12*b* is used. Modular element assembly 22' may provide an advantage in that the quantity of signal channels 32 and/or signal distribution circuits 34 used may be reduced by a factor of 2, thus providing a reduction in the weight, size, and costs relative to other antenna arrays having twice as many signal channels 32 and/or signal distribution circuits 34.

FIG. 4 is a schematic diagram showing another coupling arrangement of the various component that may be implemented on another embodiment of a modular element assembly 22" of FIG. 2. This particular coupling arrangement includes multiple radiating elements 18*a* and corresponding signal channels 32 that form first antenna array 12*a*, and multiple radiating elements 18*b* and corresponding signal channels 32 that form second antenna array 12*b* in a manner similar to the modular element assembly 22' as shown and described with reference to FIG. 3. Modular element assembly 22" of FIG. 4 differs, however, in that it includes multiple switches 36' for switching between signal channels 32 coupled to antenna elements 18*a*, and signal channels 32 coupled to antenna elements 18*b*. Additionally, a common signal distribution circuit 34 is provided that is shared by first antenna array 12*a* and second antenna array 12*b*.

Switches 36' alternatively couple signal distribution circuit 34 between signal channels 32 of first antenna array 12*a*, and signal channels 32 of second antenna array 12*b*. In this configuration, a beam may be generated by first antenna array 12*a* while the second antenna array 12*b* is idle. Alternatively, another beam may be generated by the second antenna array 12*b* while the first antenna array 12*a* is idle. Embodiments of modular element assembly 22" may provide an advantage over modular element assembly 22' of FIG. 3 in that signal channels 32 may be directly coupled to their respective antenna elements 18*a* and 18*b* for improved performance. Modular element assembly 22" may also utilize a signal distribution circuit 34, coldplate 26, and/or support structure that is common to both antenna arrays 12*a* and 12*b*.

Figure 5:
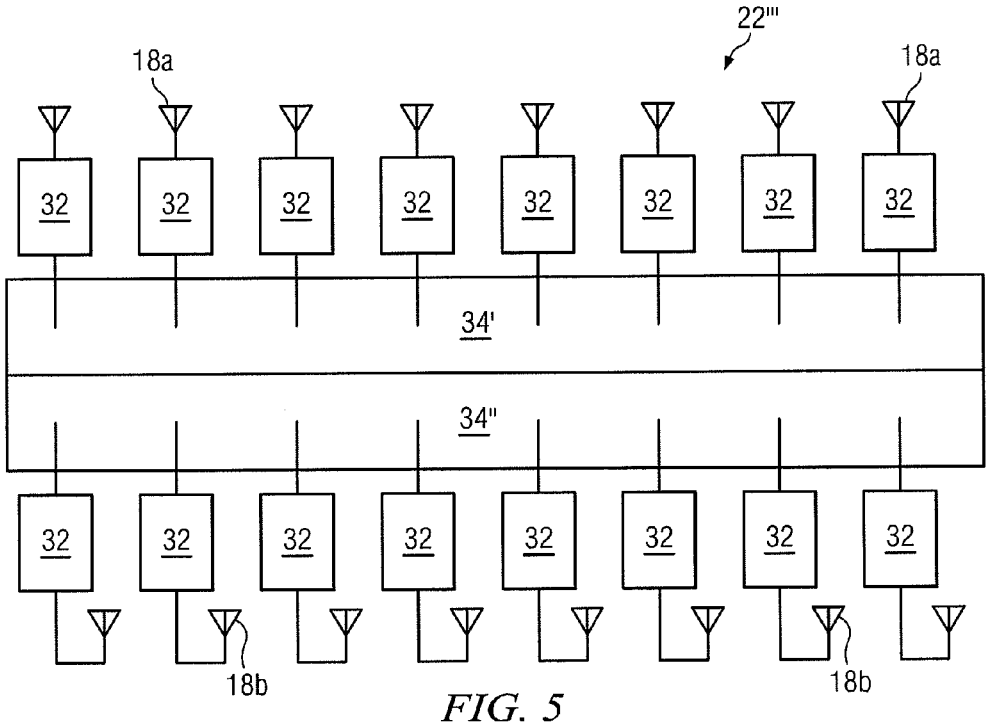
FIG. 5 is a schematic diagram showing another coupling arrangement of the various components that may be implemented on another embodiment of a modular element assembly of FIG. 2.

FIG. 5 is a schematic diagram showing another coupling arrangement of the various components that may be implemented on another embodiment of a modular element assembly 22''' of FIG. 2. This particular coupling arrangement includes multiple radiating elements 18*a* and corresponding signal channels 32 that form first antenna array 12*a*, and multiple radiating elements 18*b* and corresponding signal channels 32 that form second antenna array 12*b*. The coupling arrangement also includes two signal distribution circuits 34' and 34", one for each antenna array 12*a* and 12*b*.

Each signal distribution circuit 34' and 34" functions independently of each other for unique, simultaneous control over their respective antenna elements 18*a* and 18*b*. For example, a beam generated by first antenna array 12*a* may be steered in one direction, while the other beam generated by second antenna array 12*b* is steered in another direction independently of the direction in which the beam is steered. Time or frequency modulation of the signals may be utilized to provide isolation. Modular element assembly 22''' may provide performance advantages similar to that of modular element assembly 22". Additionally, modular element assembly 22''' may be implemented with a common cooling system and/or support structure in a similar manner to modular element assembly 22' or modular element assembly 22".

Figure 6:
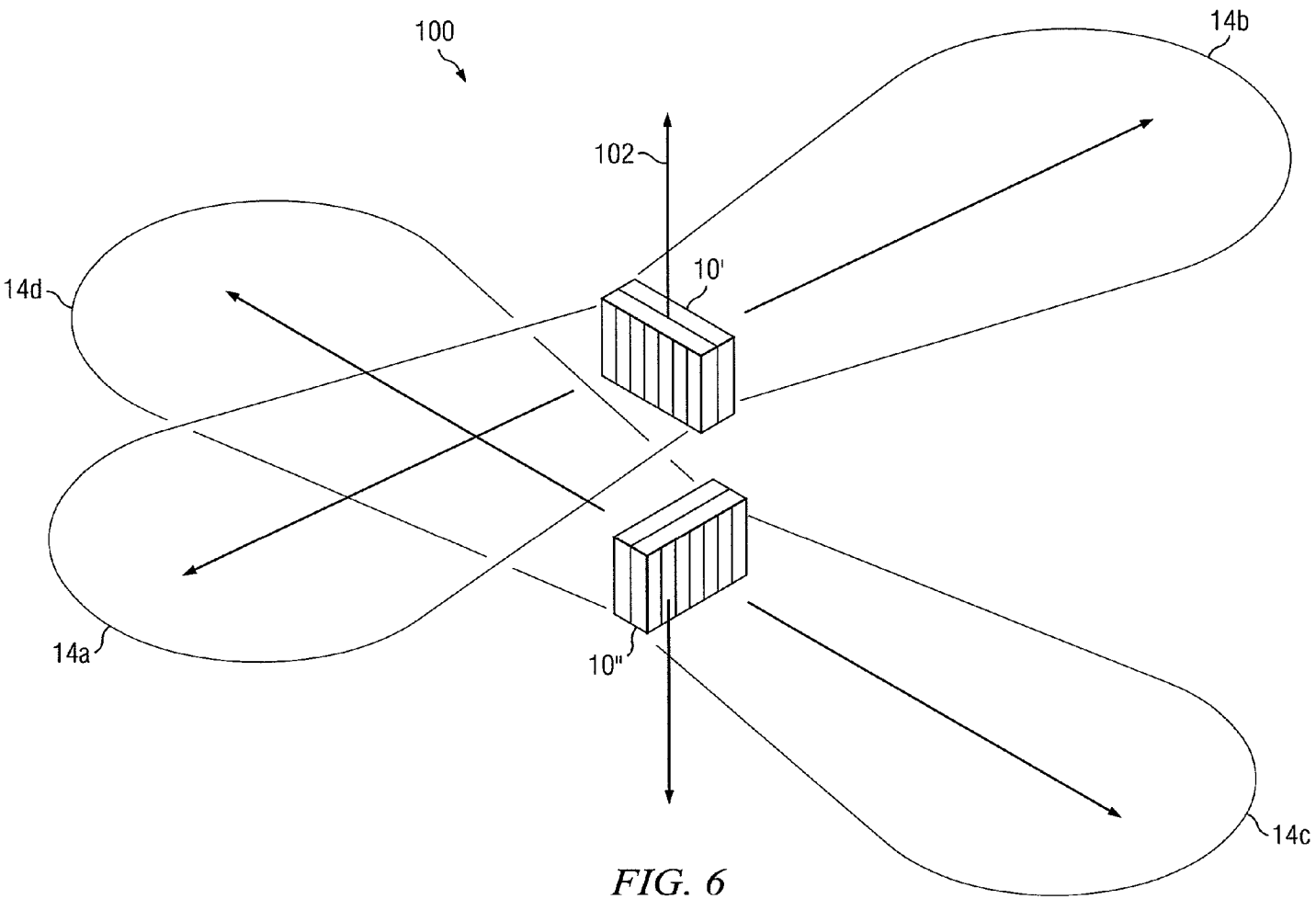
FIG. 6 is an illustration showing a perspective view of another embodiment of a combined antenna array in which two multi-orientation antenna arrays of FIG. 1 are configured in a perpendicular relationship relative to one another along a common azimuthal axis.

FIG. 6 is an illustration showing a perspective view of another embodiment of a combined antenna array 100 in which two multi-orientation antenna arrays 10' and 10" of FIG. 1 are configured in a perpendicular relationship relative to one another along a common vertical axis 102. A separation between the two antenna arrays 10' and 10" is provided to eliminate blockage depending upon the scan region to be implemented. Each multi-orientation antenna array 10' and 10" may be similar to the multi-orientation antenna array 10 of FIGS. 1 through 5. Combined antenna array 100 of FIG. 6 differs from multi-orientation antenna array 10 however in that combined antenna array 100 may have four scan volumes 14*a*, 14*b*, 14*c*, and 14*d* rather than two provided by the multi-orientation antenna array 10 of FIGS. 1 through 5.

Each multi-orientation antenna array 10 may have scan volumes 14*a*, 14*b*, 14*c*, and 14*d* that are approximately 120 degrees wide along their azimuthal extent. Antenna array 10 provides expanded azimuthal coverage relative to the azimuthal coverage provided by multi-orientation antenna array 10. As shown, combined antenna array 100 may provide azimuthal coverage that may be up to, and including a 360 degree azimuthal extent around combined antenna array 100.

Figure 7:
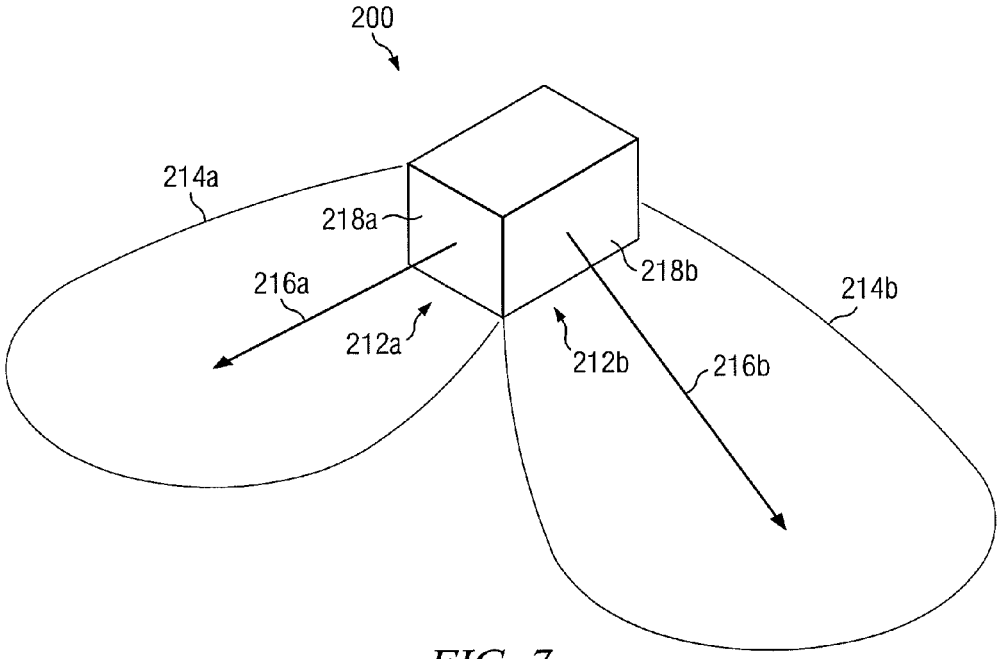
FIG. 7 is an illustration showing a perspective view of another embodiment of the multi-orientation antenna array according to the teachings of the present disclosure.

FIG. 7 is an illustration showing a perspective view of another embodiment of the multi-orientation antenna array 200 according to the teachings of the present disclosure. Multi-orientation antenna array 200 has a first antenna array 212*a* and a second antenna array 212*b* that are similar in design and construction to first antenna array 12*a* and second antenna array 12*b* of the antenna array 10 of FIG. 1. First antenna array 212*a* includes multiple antenna elements 218*a* that are oriented in a plane perpendicular to direction 216*a*; and second antenna array 212*b* includes multiple antenna elements 218*b* that are oriented in a plane perpendicular to direction 216*b*. Multi-orientation antenna array 200 differs, however, in that first antenna array 212*a* and second antenna array 212*b* are arranged in their support structure such that beams may be generated in scan volume 214*a* and scan volume 214*b* having a direction 216*a* and direction 216*b*, respectively, that are oblique relative to one another.

Figure 8:
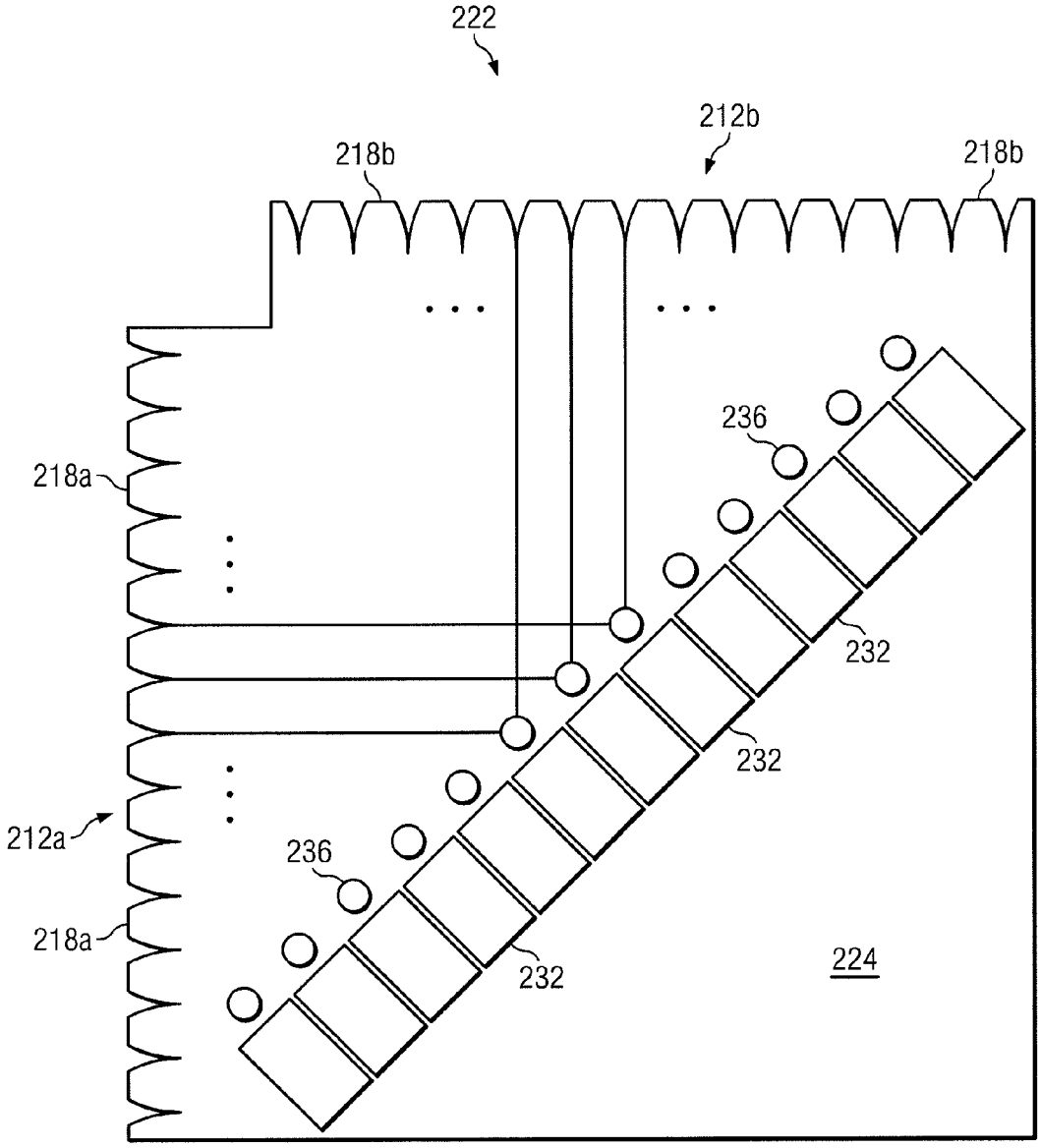
FIG. 8 illustrates a top view of one embodiment of a modular element assembly that forms a portion of each antenna array of FIG. 7.

FIG. 8 illustrates a top view of one embodiment of a modular element assembly 222 that forms a portion of each antenna array 212*a* and 212*b* of FIG. 7. Modular element assembly 222 includes a circuit board 224, multiple signal channels 232, and multiple switches 236 that are coupled to multiple antenna elements 218*a* and 218*b* of each antenna array 212*a* and 212*b*, respectively. As shown, antenna elements 218*a* and 218*b* are arranged on circuit board 224 such that they form an angle relative to each other, which in this particular embodiment is 90 degrees relative to each other. In other embodiments, antenna elements 218*a* and 218*b* may be arranged on circuit board 224 such that they form any desired angle relative to one another. For example, antenna elements 218*a* and 218*b* may form an angle that is less than 90 degrees or greater than 90 degrees relative to one another.

Modifications, additions, or omissions may be made to multi-orientation antenna array 10, 100, or 200 without departing from the scope of the invention. The components of multi-orientation antenna array 10, 100, or 200 may be integrated or separated. For example, circuitry comprising signal channels 32 may be provided as circuit modules separately from signal distribution circuit 34, or signal channels 32 may be integrally formed with signal distribution circuit 34. Moreover, the operations of multi-orientation antenna array 10, 100, or 200 may be performed by more, fewer, or other components. For example, each modular element assembly 22 may include other circuitry, such as power circuits or other signal conditioning circuits that conditions electrical signals received by, or transmitted to antenna elements 18*a* and/or 18*b*. Additionally, operations of signal distribution circuit 34 may be controlled by any type of controller, such as those using any suitable logic comprising software, hardware, and/or other logic. As used in this document, "each" refers to each member of a set or each member of a subset of a set.

Although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

What is claimed is:

1. An antenna apparatus comprising:

a first support structure;

a plurality of stacked antenna assemblies coupled to the first support structure, each antenna assembly in the stack comprising:

a first antenna array comprising a plurality of first antenna elements formed adjacent to a first edge of a second support structure and oriented in a first boresight direction, such that and aperture of the first antenna array is aligned along the first edge;

a second antenna array comprising a plurality of second antenna elements formed adjacent to a second edge of the second support structure and oriented in a second boresight direction that is different from the first boresight direction, such that an aperture of the second antenna array is aligned along the second edge;

a plurality of signal channels that are each coupled to each of the plurality of first antenna elements and the plurality of second antenna elements through a switching circuit, such that the plurality of signal channels are shared by the plurality of first antenna elements and the plurality of second antenna elements;

a signal distribution circuit that is coupled, via the switching circuit, to at least one of the plurality of first antenna elements and the plurality of second antenna elements, such that the signal distribution circuit is shred by the plurality of first antenna elements and the plurality of second antenna elements;

wherein the support structure and the plurality of stacked antenna assemblies are constructed and arranged such that each respective first antenna array in the stack is oriented to the first boresight direction and each respective second antenna array in the stack is oriented to the second boresight direction.

2. The antenna apparatus of claim 1, wherein, on each respective antenna assembly in the stack, the first antenna array and the second antenna array are constructed and arranged so that the first boresight direction and the second boresight direction are oriented in one of the following arrangements:

(a) the first boresight direction is at an angle of approximately one hundred eighty degrees)(180°) from the second boresight direction;

(b) the first boresight direction is at an angle of approximately ninety degrees (90°) from the second boresight direction; and (c) the first boresight direction is at an oblique angle to the second boresight direction.

3. The antenna apparatus of claim 1, wherein:

the signal distribution circuit on each antenna assembly in the stack is configured so that, when it is coupled to at least a respective one of the plurality of first antenna elements or plurality of second antenna elements, the signal distribution circuit enables the respective at least one plurality of antenna elements to which it is connected to either transmit or receive a signal; and the at least one respective plurality of antenna elements, that is coupled to the signal distribution circuit, transmits or receives the signal in the respective first or second boresight direction within a respective scan volume having a respective elevation height and azimuthal width, wherein the scan volume for the first plurality of antenna elements is distinct from the scan volume for the second plurality of antenna elements.

4. The antenna apparatus of claim 1, wherein the switching circuit is constructed and arranged to couple only one of the plurality of first antenna elements and the plurality of second antenna elements to the signal distribution circuit at a time.

5. An antenna apparatus comprising:

a first support structure, the first support structure having at least first and second distinct edges; and a first multi-orientation antenna operably coupled to the first support structure, the first multi-orientation antenna comprising:

a first antenna array disposed adjacent to the first edge of the first support structure and comprising a plurality of first antenna elements oriented in a first boresight direction, such that an aperture of the first antenna array is aligned along the first edge, wherein the first antenna array is constructed and arranged so that, when the first antenna array is coupled to a signal distribution circuit, the first antenna array either generates a first beam that operates within a first scan volume or receives a signal transmitted to a first location covered by the first scan volume, wherein the first scan volume has a first elevation height and a first azimuthal width;

a second antenna array disposed adjacent to the second edge of the first support structure and comprising a plurality of second antenna elements oriented in a second boresight direction that is different from the first boresight direction, such that an aperture of the second antenna array is aligned along the second edge, wherein the second antenna array is constructed and arranged so that, when the second antenna array is coupled to the signal distribution circuit, the second antenna array either generates a second beam that operates within a second scan volume or receives a signal transmitted to a second location covered by the second scan volume, wherein the second scan volume is distinct from than the first scan volume and has a second elevation height and a second azimuthal width; and a switching circuit operably coupled to both the first and second antenna arrays, the switching circuit configured to couple at least one of the first antenna array and the second antenna array to the signal distribution circuit, such that the signal distribution circuit is shared by the first and second antenna arrays.

6. The antenna apparatus of claim 5, wherein the second boresight direction is oriented relative to the first boresight direction in one of the following arrangements:

(a) the first boresight direction is at an angle of approximately one hundred eighty degrees (180°) from the second boresight direction, so as to opposite to the first boresight direction;

(b) the first boresight direction is at an angle of approximately ninety degrees (90°) from the second boresight direction; and (c) the first boresight direction is at an oblique angle to the second boresight direction.

7. The antenna apparatus of claim 5, wherein the first antenna array and the second antenna array are configured together so as to share at least one of a common cooling system and a common power distribution circuit.

8. The antenna apparatus of claim 5, wherein the switching circuit comprises a plurality of switches and further comprising a plurality of signal channels that are coupled between corresponding ones of the plurality of switches and the signal distribution circuit such that the plurality of signal channels are common to the plurality of first antenna elements and the plurality of second antenna elements.

9. The antenna apparatus of claim 5, wherein the switching circuit comprises a plurality of switches and further comprising a plurality of first signal channels and a plurality of second signal channels, the plurality of first signal channels being coupled between the plurality of first antenna elements and the plurality of switches, the plurality of second signal channels being coupled between the plurality of second antenna elements and the plurality of switches.

10. The antenna apparatus of claim 5, wherein the plurality of first antenna elements and the plurality of second antenna elements comprise slotline radiators.

11. A first antenna apparatus of claim 5 coupled to a second antenna apparatus of claim 2, the first and second antenna array of the first antenna apparatus oriented in a first and second boresight direction that is perpendicular to the first and second boresight direction of the first and second antenna array of the second antenna apparatus, such that the first and second scan volumes of the first antenna apparatus are distinct from the first and second scan volumes of the second antenna apparatus.

12. The antenna apparatus of claim 5, wherein the switching circuit is constructed and arranged to couple only one of the plurality of first antenna elements and the plurality of second antenna elements to the signal distribution circuit at a time.

13. A first antenna apparatus of claim 5 operably stacked to a second antenna apparatus of claim 2, such that the first antenna array of the first antenna apparatus and the first antenna array of the second antenna apparatus are both oriented in the first boresight direction and the second antenna array of the first antenna apparatus and the second antenna array of the second antenna apparatus are both oriented in the second boresight direction.

14. The antenna apparatus of claim 5, wherein at least one of the first and second antenna arrays comprises a first polarized radiating element oriented in a first direction and wherein at least one of the first and second antenna arrays comprises a second polarized radiating element that is oriented in a second direction, wherein the second direction is orthogonal to the first direction.

15. A method for operating an antenna, the method comprising:

providing a transmission signal suitable for transmission using an antenna array;

operably coupling together a first plurality of antenna assemblies into a first stack, each antenna assembly in the first stack comprising:

a first antenna array comprising a plurality of first antenna elements formed adjacent to a first edge of a first support structure and oriented in a first boresight direction, such that an aperture of the first antenna array is aligned along the first edge;

a second antenna array comprising a plurality of second antenna elements formed adjacent to a second edge of the first support structure and oriented in a second boresight direction that is different from the first boresight direction, wherein an aperture of the second antenna array is aligned along the second edge;

a plurality of first signal channels that are each coupled to each of the plurality of first antenna elements and the plurality of second antenna elements, such that the plurality of first signal channels are shared by the plurality of first antenna elements and the plurality of second antenna elements;

a first signal distribution circuit that is operably coupled to at least one of the plurality of first antenna elements and the plurality of second antenna elements, such that the first signal distribution circuit is shared by the plurality of first antenna elements and the plurality of second antenna elements;

operably coupling the transmission signal to the first stack;

generating, if the transmission signal is received at the first antenna array in the first stack, a first beam in the first boresight direction, the first beam disposed within a first scan volume having a first elevation height and a first azimuthal width; and generating, if the transmission signal is received at the second antenna array in the first stack, a second beam in the second boresight direction, wherein the second boresight direction is different from the first boresight direction, and the second beam is disposed within a second scan volume having a second elevation height and a second azimuthal width, wherein the second scan volume is distinct from the first scan volume.

16. The method of claim 15, further comprising orienting the first antenna array to the second antenna array in one of the following arrangements;

(a) the first boresight direction is at an angel of approximately one hundred eighty degrees (180°) from the second boresight direction;

(b) the first boresight direction is at an angle of approximately ninety degrees (90°) from the second boresight direction; and (c) the first boresight direction is at an oblique angle to the second boresight direction.

17. The method of claim 15, further comprising at least one of:

cooling the first antenna array and the second antenna array using a common cooling system and powering the first antenna array and the second antenna array using a common power distribution circuit.

18. The method of claim 15, further comprising alternatively coupling the transmission signal to one of the first antenna array and the second antenna array, such that only one at a time of the first antenna array and the second antenna array is generating a respective beam.

19. The method of claim 15, wherein the plurality of first antenna elements and the plurality of second antenna elements comprise slotline radiators.

20. The method of claim 15, further comprising:

operably coupling together a second plurality of antenna assemblies into a second stack, each antenna assembly in the second stack comprising:

a third antenna array comprising a plurality of third antenna elements formed adjacent to a third edge of a second support structure and oriented in a third boresight direction that is different from the first and second boresight directions;

a fourth antenna array comprising a plurality of fourth antenna elements formed adjacent to a fourth edge of the second support structure and oriented in a fourth boresight direction that is different from the first, second, and third boresight directions;

a plurality of second signal channels that are each coupled to each of the plurality of third antenna elements and the plurality of fourth antenna elements, such that the plurality of second signal channels are shared by the plurality of third antenna elements and the plurality of fourth antenna elements;

a second signal distribution circuit that is operably coupled to at least one of the plurality of third antenna elements and the plurality of fourth antenna elements, such that the second signal distribution circuit is shared by the plurality of third antenna elements and the plurality of fourth antenna elements;

generating, if the transmission signal is received at the third array, a third beam in the third boresight direction by the third antenna array, the third beam associated with a third scan volume, wherein the third scan volume is distinct from the first and second scan volumes;

generating, if the transmission signal is received at the fourth antenna array, a fourth beam in the fourth boresight direction by fourth antenna array, the fourth beam associated with a fourth scan volume, wherein the fourth scan volume is distinct from the first second and third scan volumes;

configuring the first and second support structures to two different locations on a common vertical axis of a third support structure, such that the second support structure is separated along the vertical axis from the first support structure by a distance sufficient to eliminate blockage between the first, second, third and fourth scan volumes.

* * * * *

UNITED STATES PATENT AND TRADEMARK OFFICE

CERTIFICATE OF CORRECTION

PATENT NO. : 8,405,548 B2
APPLICATION NO. : 12/851174
DATED : March 26, 2013
INVENTOR(S) : William P. Hull et al.

It is certified that error appears in the above-identified patent and that said Letters Patent is hereby corrected as shown below:

In the Claims:

Claim 1, in Column 7, line 35, delete "and" and insert -- an --; and
Claim 1, in Column 7, line 54, delete "shred" and insert -- shared --.

Signed and Sealed this
Twenty-seventh Day of May, 2014

Michelle K. Lee

Michelle K. Lee
*Deputy Director of the United States Patent and Trademark Office*